US007694756B2

(12) United States Patent
Hall et al.

(10) Patent No.: US 7,694,756 B2
(45) Date of Patent: Apr. 13, 2010

(54) INDENTING MEMBER FOR A DRILL BIT

(76) Inventors: David R. Hall, 2185 S. Larsen Pkwy., Provo, UT (US) 84606; Francis Leany, 2185 S. Larsen Pkwy., Provo, UT (US) 84606; John Bailey, 2185 S. Larsen Pkwy., Provo, UT (US) 84606

( * ) Notice: Subject to any disclaimer, the term of this patent is extended or adjusted under 35 U.S.C. 154(b) by 312 days.

(21) Appl. No.: 11/871,644

(22) Filed: Oct. 12, 2007

(65) Prior Publication Data

US 2008/0029312 A1 Feb. 7, 2008

Related U.S. Application Data

(63) Continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 10/04* (2006.01)
*E21B 10/26* (2006.01)

(52) U.S. Cl. ..... 175/404; 175/385

(58) Field of Classification Search ..... 175/385, 175/393, 404, 405.1

See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Locker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |

(Continued)

*Primary Examiner*—Hoang Dang
(74) *Attorney, Agent, or Firm*—Tyson J. Wilde

(57) ABSTRACT

A drill bit has a bit body intermediate a working face and a shank end adapted for connection to a downhole drill string. The working face has at least three fixed blades converging towards a center of the working face and diverging towards a gauge of the bit, at least one blade having a cone region adjacent the center of the working face. The cone region increases in height away from the center of the working face and towards a nose portion of the at least one blade. An opening is formed in the working face at the center of the bit along an axis of the drill bit's rotation, the opening leading into a chamber with at least one wall. An indenting member is disposed within and extends from the opening, is substantially coaxial with the axis of rotation, and is fixed to the wall of the chamber.

20 Claims, 13 Drawing Sheets

U.S. PATENT DOCUMENTS 1,460,671 A 7/1923 Hebsacker
1,544,757 A 7/1925 Hufford
1,821,474 A 9/1931 Meroer
1,879,177 A 9/1932 Gault
2,054,255 A 9/1936 Howard
2,064,255 A 12/1936 Garfield
2,169,223 A 8/1939 Christian
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,807,443 A * 9/1957 Wyman ..... 175/404
2,819,043 A 1/1958 Henderson
2,838,284 A 6/1958 Austin
2,894,722 A 7/1959 Buttolph
2,901,223 A 8/1959 Scatt
2,963,102 A 12/1960 Smith
3,059,708 A * 10/1962 Cannon et al. ..... 175/393
3,135,341 A 6/1964 Ritter
3,294,186 A 12/1966 Buell
3,301,339 A 1/1967 Pennebaker, Jr.
3,379,264 A 4/1968 Cox
3,429,390 A 2/1969 Bennett
3,493,165 A 2/1970 Scnonfield
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,109,737 A 8/1978 Bovenkerk
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,733,734 A * 3/1988 Bardin et al. ..... 175/65
4,852,672 A 8/1989 Behrens
4,889,017 A 12/1989 Fuller
4,962,822 A 10/1990 Pascale
4,981,184 A * 1/1991 Knowlton et al. ..... 175/429
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A * 3/1998 Nelson ..... 175/385
5,794,728 A 8/1998 Palmberg
5,848,657 A 12/1998 Flood
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott et al.
5,992,547 A 11/1999 Caraway
5,992,548 A 11/1999 Silva
6,021,859 A 2/2000 Tibbitts
6,039,131 A 3/2000 Beaton
6,131,675 A * 10/2000 Anderson ..... 175/268
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,253,864 B1 7/2001 Hall
6,269,893 B1 8/2001 Beaton
6,296,069 B1 10/2001 Lamine
6,332,503 B1 12/2001 Pessier
6,340,064 B2 1/2002 Fielder
6,364,034 B1 4/2002 Schoeffler
6,394,200 B1 5/2002 Watson
6,408,959 B2 6/2002 Bertagnolli
6,439,326 B1 8/2002 Huang
6,474,425 B1 11/2002 Truax
6,484,825 B2 11/2002 Watson
6,484,826 B1 11/2002 Anderson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,672,406 B2 1/2004 Beuershausen
6,729,420 B2 5/2004 Mensa-Wilmot
6,732,817 B2 5/2004 Dewey
6,822,579 B2 11/2004 Goswani
6,929,076 B2 8/2005 Fanuel
6,953,096 B2 10/2005 Gledhill
2001/0004946 A1 6/2001 Jensen
2003/0213621 A1 11/2003 Britten
2004/0238221 A1 12/2004 Runia
2004/0256155 A1 12/2004 Kriesels

* cited by examiner

INDENTING MEMBER FOR A DRILL BIT

CROSS REFERENCE TO RELATED APPLICATION

This Patent Application is a continuation-in-part of U.S. patent application Ser. No. 11/278,935 filed on Apr. 6, 2006 now U.S. Pat. No. 7,426,968 and which is entitled Drill Bit Assembly with a Probe. U.S. patent application Ser. No. 11/278,935 is a continuation-in-part of U.S. patent application Ser. No. 11/277,394 which filed on Mar. 24, 2006 now U.S. Pat. No. 7,398,837 and entitled Drill Bit Assembly with a Logging Device. U.S. patent application Ser. No. 11/277,394 is a continuation in-part of U.S. patent application Ser. No. 11/277,380 also filed on Mar. 24, 2006 now U.S. Pat. No. 7,337,858 and entitled A Drill Bit Assembly Adapted to Provide Power Downhole. U.S. patent application Ser. No. 11/277,380 is a continuation-in-part of U.S. patent application Ser. No. 11/306,976 which was filed on Jan. 18, 2006 now U.S. Pat. No. 7,360,610 and entitled "Drill Bit Assembly for Directional Drilling." U.S. patent application Ser. No. 11/306,976 is a continuation-in-part of Ser. No. 11/306,307 filed on Dec. 22, 2005 now U.S. Pat. No. 7,225,886, entitled Drill Bit Assembly with an Indenting Member. U.S. patent application Ser. No. 11/306,307 is a continuation-in-part of U.S. patent application Ser. No. 11/306,022 filed on Dec. 14, 2005 now U.S. Pat. No. 7,198,119, entitled Hydraulic Drill Bit Assembly. U.S. patent application Ser. No. 11/306,022 is a continuation-in-part of U.S. patent application Ser. No. 11/164,391 filed on Nov. 21, 2005 now U.S. Pat. No. 7,270,196, which is entitled Drill Bit Assembly. All of these applications are herein incorporated by reference in their entirety.

BACKGROUND OF THE INVENTION

This invention relates to drill bits, specifically drill bit assemblies for use in oil, gas and geothermal drilling. Often drill bits are subjected to harsh conditions when drilling below the earth's surface. Replacing damaged drill bits in the field is often costly and time consuming since the entire downhole tool string must typically be removed from the borehole before the drill bit can be reached. Bit whirl in hard formations may result in damage to the drill bit and reduce penetration rates. Further, loading too much weight on the drill bit when drilling through a hard formation may exceed the bit's capabilities and also result in damage. Too often unexpected hard formations are encountered suddenly and damage to the drill bit occurs before the weight on the drill bit may be adjusted.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutting element chamfer size and backrake angle, as well as cutting element backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutting elements mounted thereon, so as to control the volume of formation material cut per bit rotation as well as the torque experienced by the bit and an associated bottomhole assembly. The exterior features preferably precede, taken in the direction of bit rotation, cutting elements with which they are associated, and provide sufficient bearing area so as to support the bit against the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a downhole sensor sub in the lower end of a drill string, such sub having three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

BRIEF SUMMARY OF THE INVENTION

A drill bit has a bit body intermediate a working face and a shank end adapted for connection to a downhole drill string. The working face has at least three fixed blades converging towards a center of the working face and diverging towards a gauge of the bit, at least one blade having a cone region adjacent the center of the working face. The cone region increases in height away from the center of the working face and towards a nose portion of the at least one blade. An opening is formed in the working face at the center of the bit along an axis of the drill bit's rotation, the opening leading into a chamber with at least one wall. An indenting member is disposed within and extends from the opening and is substantially coaxial with the axis of rotation. The indenting member is rotationally and axially fixed to the wall of the chamber and is made of a material harder than the bit body.

The indenting member may be substantially cylindrical along its length. The indenting member may comprise a rounded distal end. The rounded distal end may comprise a domed shape, a conical shape, or a semi-spherical shape. The indenting member may be solid. The indenting member may comprise a substantially symmetric distal end.

The indenting member may be brazed to the wall of the chamber. The indenting member may be held within the chamber through an interference fit. The chamber may comprise a closed end. The chamber may comprise a port in fluid communication with a bore formed in the bit body which is adapted to facilitate flow of drilling mud during a drilling operation. The indenting member may comprise a braze joint.

The bit body may be made of steel and/or matrix. The center of the working face may be within a cone region formed by the at least three blades. A closest cutting element secured to the at least one blade may comprise a distal most end located a distance from the working surface, wherein the indenting member does not extend beyond the distance. The indenting member may not extend beyond a nose portion of the at least one blade. A pointed cutting element may be secured to the at least one blade. The indenting member may comprise a larger diameter than a cutting element secured to at least one of the blades. The indenting member may comprise a larger volume than a cutting element secured to at least one of the blades. The at least one blade may also comprise a nose portion and a flank region.

In some embodiments of the present invention, a junk slot with a base is formed by the blades and at least one high pressure nozzle is disposed between at least two blades in a nozzle bore formed in an elevated surface from the base of the junk slots. The elevated surface is disposed adjacent the diamond working end of the least one cutting surface.

DETAILED DESCRIPTION OF THE INVENTION AND THE PREFERRED EMBODIMENT

Figure 1:
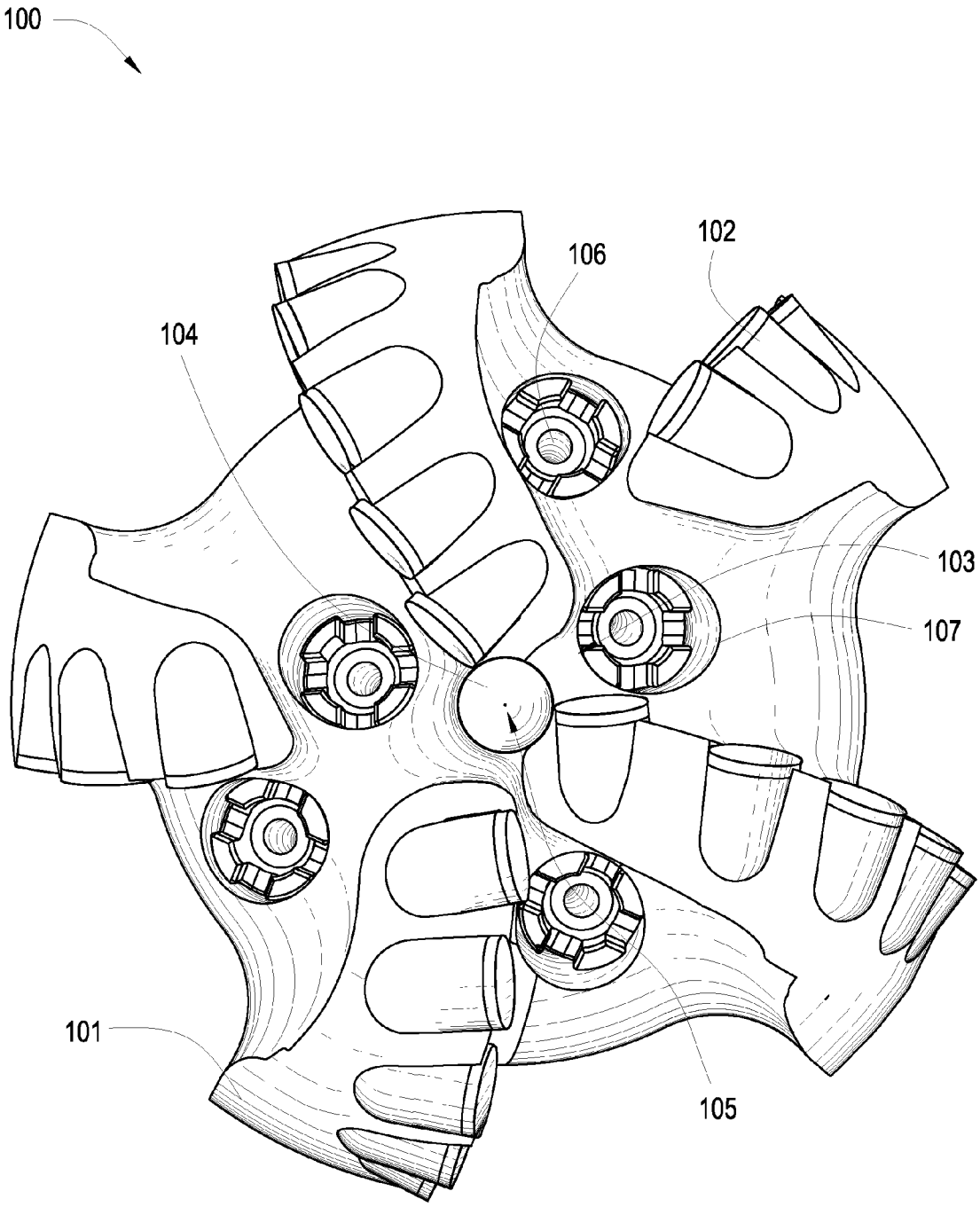
FIG. 1 is a bottom perspective diagram of an embodiment of a drill bit.
Figure 2:
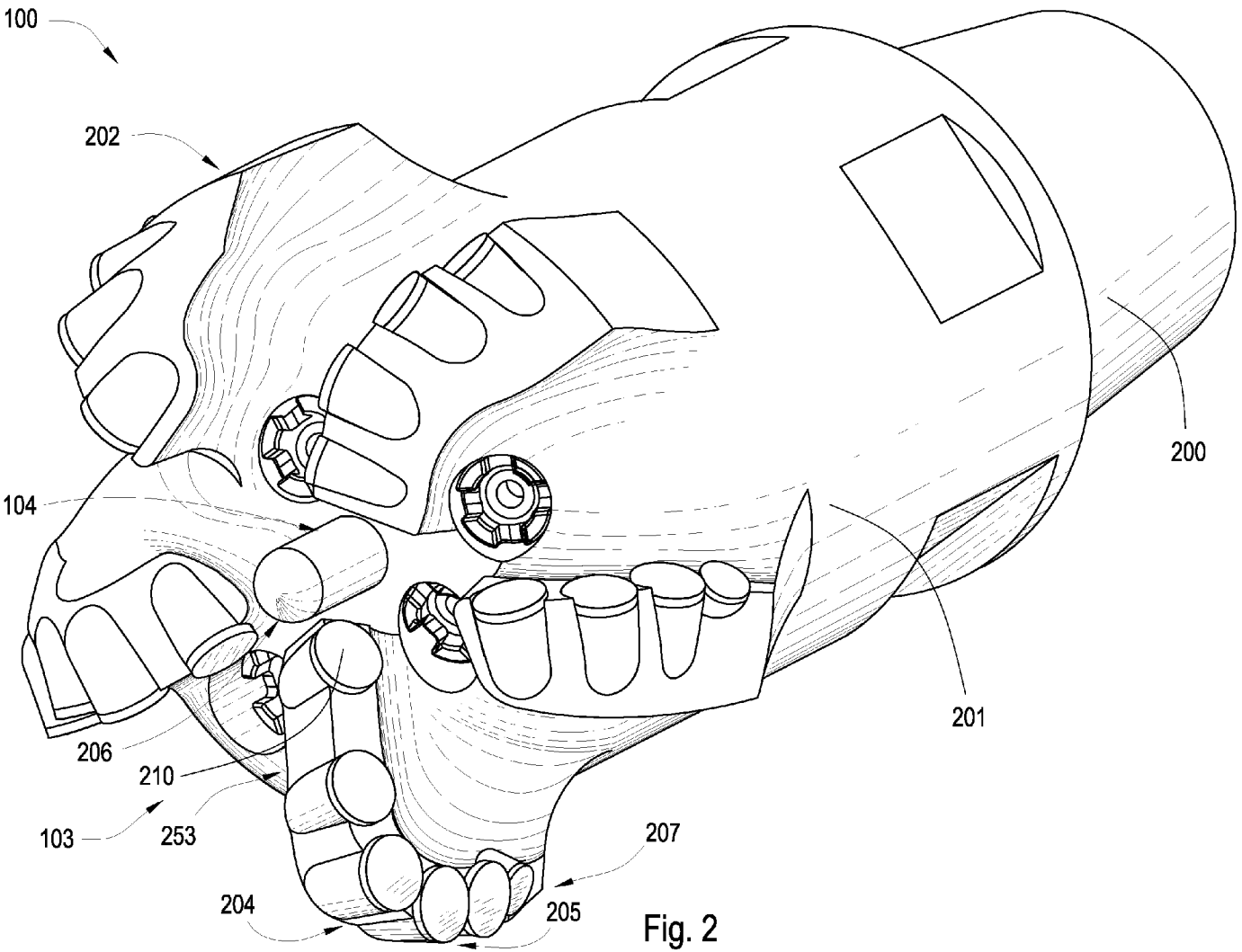
FIG. 2 is a perspective diagram of an embodiment of a drill bit.

FIGS. 1 and 2 disclose a drill bit 100 of the present invention. The drill bit 100 comprises a shank 200 which is adapted for connection to a downhole tool string such as a drill string made of rigid drill pipe, drill collars, heavy weight pipe, reamers, jars, and/or subs. In some embodiments coiled tubing or other types of tool string may be used. The drill bit 100 of the present invention is intended for deep oil and gas drilling, although any type of drilling is anticipated such as horizontal drilling, geothermal drilling, mining, exploration, on and off-shore drilling, directional drilling, and any combination thereof. The bit body 201 is attached to the shank 200 and comprises an end which forms a working face 202. A plurality of blades 101 extend outwardly from the bit body 201, each of which comprises a plurality of cutting elements 102. A drill bit 100 most suitable for the present invention may have at least three blades 101; preferably, the drill bit 100 will have between three and seven blades 101. The blades 101 collectively form an inverted cone region 103. Each blade 101 may have a cone portion 253, a nose portion 204, a flank portion 205, and a gauge portion 207. Cutting elements 102 may be arrayed along any portion of the blades, including the cone portion 253, noseportion 204, flank portion 205, and gauge portion 207.

An indenting member 104 is substantially coaxial with an axis 105 of rotation and extends within the cone region 103. A plurality of nozzles 106 are fitted into recesses 107 formed in the working face 202. Each nozzle 106 may be oriented such that a jet of drilling mud ejected from the nozzles 106 engages the formation before or after the cutting elements 102. The jets of drilling mud may also be used to clean cuttings away from drill bit 100. In some embodiments, the jets may be used to create a sucking effect to remove drill bit cuttings adjacent the cutting elements 102 and/or the indenting member 104 by creating a low pressure region within their vicinities.

Figure 3:
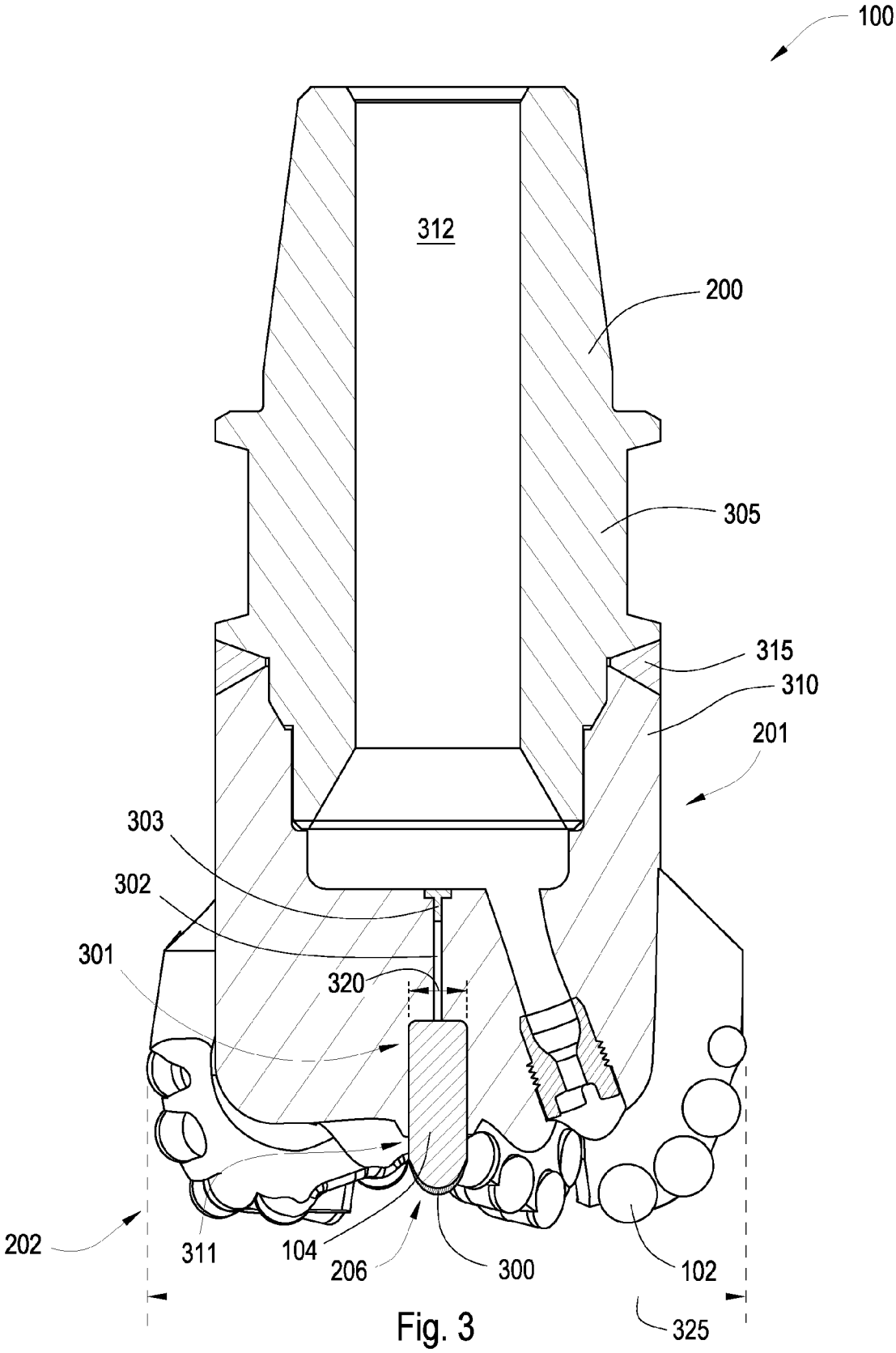
FIG. 3 is a cross sectional diagram of an embodiment of a drill bit.

FIG. 3 discloses a cross section of an embodiment of the drill bit 100. The indenting member 104 may comprise a hard surface 300 of a least 63 HRc. The hard surface 300 may be attached to a rounded distal end 206 of the indenting member 104, but it may also be attached to any portion of the indenting member 104. In some embodiments, the indenting member 104 comprises tungsten carbide with polycrystalline diamond bonded to its distal end 206. Preferably, the cutting elements 102 also comprise a hard surface made of polycrystalline diamond. In some embodiments, the cutting elements 102 and/or distal end 206 of the indenting member 104 comprise a diamond or cubic boron nitride surface. The diamond may be selected from the group consisting of polycrystalline diamond, natural diamond, synthetic diamond, vapor deposited diamond, silicon bonded diamond, cobalt bonded diamond, thermally stable diamond, polycrystalline diamond with a cobalt concentration of 1 to 40 weight percent, infiltrated diamond, layered diamond, polished diamond, course diamond, fine diamond or combinations thereof. In some embodiments, the indenting member 104 is made primarily from a cemented carbide with a binder concentration of 1 to 40 weight percent, preferably of cobalt. The working face 202 of the drill bit 100 may be made of a steel, a matrix, or a carbide as well. The cutting elements 102 or distal end 206 of the indenting member 104 may also be made out of hardened steel or may comprise a coating of chromium, titanium, aluminum or combinations thereof.

The indenting member 104 is disposed within a chamber 301 formed in the bit body 201. An opening 311 in the working face 202 leads into the chamber 301. The indenting member 104 may be brazed, press fit, welded, threaded, nailed, or otherwise fastened to a wall of the chamber 301, such that the indenting member 104 is rotationally and axially fixed to the wall. Preferably, the indenting member 104 may be held within the chamber 301 through an interference fit. The chamber 301 may comprise a closed end. In some embodiments, the tolerances are tight enough that a port 302 is desirable to allow air to escape upon insertion into the chamber 301 and allow air to fill in the chamber 301 upon removal of the indenting member 104. The port 302 may be in fluid communication with a bore 312 in the bit body which is adapted to facilitate flow of drilling mud during a drilling operation. A plug 303 may be used to isolate the internal pressure of the drill bit 100 from the chamber 301. In some embodiments, there is no chamber 301 and the indenting member 104 is attached to a flat portion of the working face.

The drill bit 100 may be made in two portions. The first portion 305 may comprise at least the shank 200 and a part of the bit body 201. The second portion 310 may comprise the working face 202 and at least another part of the bit body 201. The two portions 305, 310 may be welded together or otherwise joined together at a joint 315.

The diameter of the indenting member 104 may affect its ability to lift the drill bit 100 in hard formations. The indenting member 104 may comprise a larger diameter than the cutting elements. The indenting member 104 may also comprise a larger volume than the cutting elements. The working face 202 may comprise a cross sectional thickness 325 of 4 to 12 times a cross sectional thickness 320 of the indenting member 104. Also the working face 202 may comprise a cross sectional area of 4 to 12 times the cross sectional area of the indenting member 104.

Figure 4:
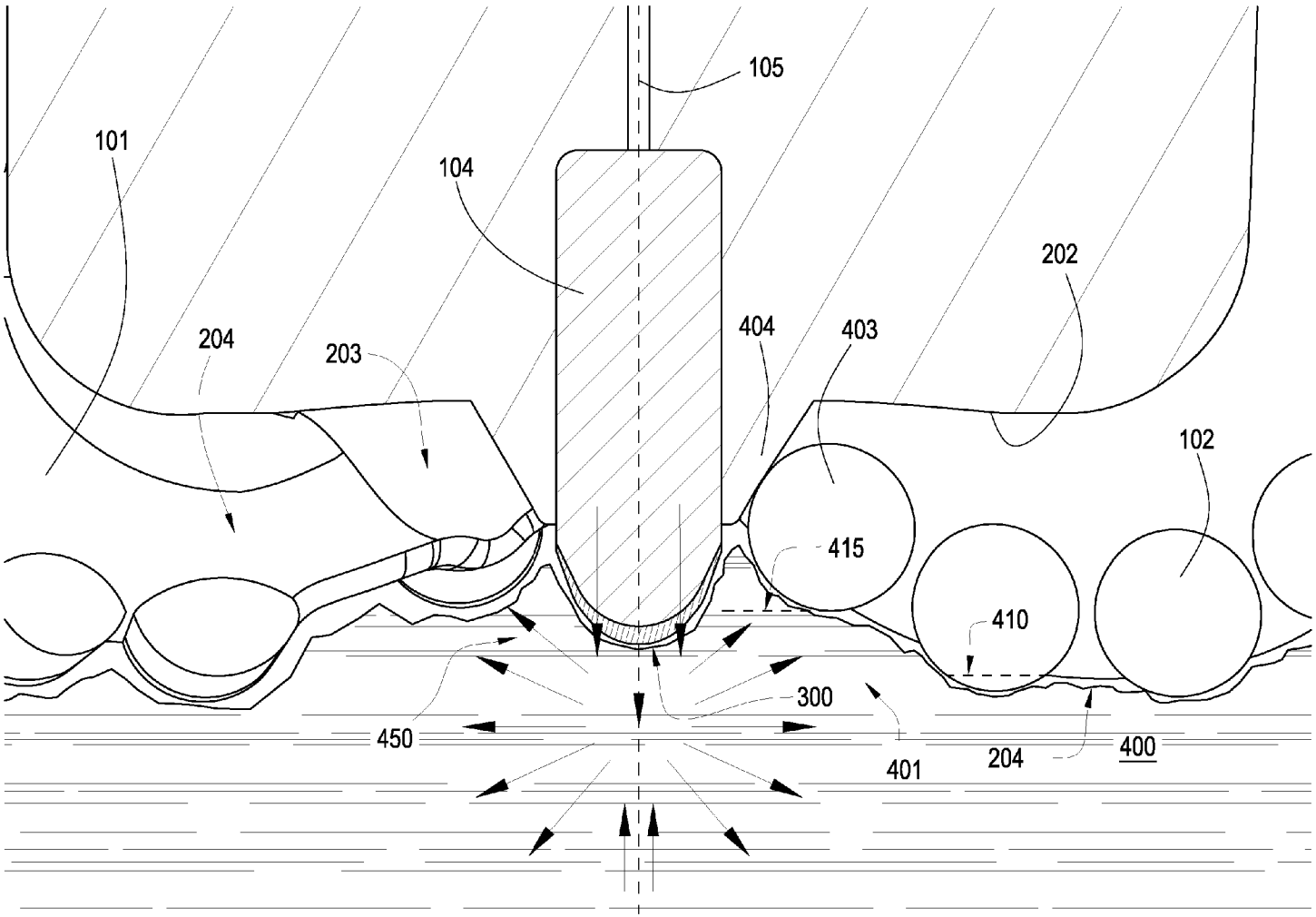
FIG. 4 is a cross sectional diagram of an embodiment of an indenting member.

FIG. 4 discloses an embodiment of the indenting member 104 engaging a formation 400. Preferably the formation is the bottom of a well bore. The effect of the indenting member 104 may depend on the hardness of the formation 400 and also the weight loaded to the drill bit 100 which is typically referred to as weight-on-bit or WOB. An important feature of the present invention is the ability of the indenting member 104 to share at least a portion of the WOB with the blades 101 and/or cutting elements 102. One feature that may allow the indenting member 104 to share at least a portion of the WOB is a blunt geometry 450 of its distal end 206.

The distal end 206 of the indenting member 104 may extend between a range defined by the working face 202 and the nose portion 204 of the at least one blade. In other embodiments, the distal end of the indenting member may extend between a range defined by the working face and a distal most end 415 of a closest cutting element 403 secured to the at least one blade, wherein the distal most end 313 is located a distance 314 from the working face 202.

One long standing problem in the industry is that cutting elements 102, such as diamond cutting elements, chip or wear in hard formations when the drill bit 100 is used too aggressively. To minimize cutting element 102 damage, the drillers will reduce the weight-on-bit 100, but all too often, a hard formation is encountered before it is detected and before the driller has time to react. With the present invention, the indenting member 104 may limit the depth of cut that the drill bit 100 may achieve per rotation in hard formations because the indenting member 104 actually jacks the drill bit 100 thereby slowing its penetration in the unforeseen hard formations. If the formation 400 is soft, the formation may not be able to resist the WOB loaded to the indenting member 104 and a minimal amount of jacking may take place. But in hard formations, the formation may be able to resist the indenting member 104, thereby lifting the drill bit 100 as the cutting elements 102 remove a volume of the formation during each rotation. As the drill bit 100 rotates and more volume is removed by the cutting elements 102 and drilling mud, less WOB will be loaded to the cutting elements 102 and more WOB will be loaded to the indenting member 104. Depending on the hardness of the formation 400, enough WOB will be focused immediately in front of the indenting member 104 such that the hard formation will compressively fail, weakening the hardness of the formation and allowing the cutting elements 102 to remove an increased volume with a minimal amount of damage.

Typically, WOB is precisely controlled at the surface of the well bore to prevent over loading the drill bit 100. In experimental testing at the D.J. Basin in Colorado, crews have added about 5,000 more pounds of WOB than typical. The crews use a downhole mud motor in addition to a top-hole motor to turn the drill string. Since more WOB increases the depth-of-cut the WOB added will also increase the traction at the bit 100 which will increase the torque required to turn the bit 100. Too much torque can be harmful to the motors rotating the drill string. Surprisingly, the crews in Colorado discovered that the additional 5,000 pounds of WOB didn't significantly add much torque to their motors. This finding is consistent with the findings of a test conducted at the Catoosa Facility in Rogers County, Oklahoma, where the addition of 10,000 to 15,000 pounds of WOB didn't add the expected torque to their motors either. The minimal increase of torque on the motors is believed to be effected by the indenting member 104. It is believed that as the WOB increases the indenting member 104 jacks the bit 100 and then compressively fails the formation 400 in front of it by focusing the WOB to the small region in front of it and thereby weakens the rest of the formation 400 in the proximity of the working face 202. By jacking the bit 100, the depth of cut is limited, until the compressive failure of the formation 400 takes place, in which the formation 400 is weaker or softer and less torque is required to drill. It is believed that the shearing failure and the compressive failure of the formation 400 happen simultaneously.

As the cutting elements 102 along the inverted cone region 103 of the drill bit 100 remove portions of the formation 400 a conical profile 401 in the formation 400 may be formed. As the indenting member 104 compressively fails the conical profile 401, the formation 400 may be pushed towards the cutting elements 102 of the conical portion 103 of the blades 101. Since cutting at the axis of rotation 105 is typically the least effective (where the cutting element 102 velocity per rotation is the lowest) the present invention provides an effective structure and method for increasing the rate of penetration (ROP) at the axis of rotation It is believed that it is easier to compressively fail and displace the conical profile 401 closer to its tip than at its base, since there is a smaller cross sectional area near the tip. If the indenting member 104 extends too far, the cross sectional area of the conical profile 401 becomes larger, which may cause it to become too hard to effectively compressively fail and/or displace it. If the indenting member 104 extends beyond the leading most point 410 of the nose portion 204, the cross sectional area of the formation may become indefinitely large and extremely hard to displace. In some embodiments, the indenting member 104 extends within 0.100 to 3 inches. In some embodiments, the indenting member 104 extends within the leading most point 410 of the nose portion 204.

As drilling advances, the indenting member 104 is believed to stabilize the drill bit 100 as well. A long standing problem in the art is bit whirl, which is solved by the indenting member 104 provided that the distal end 206 of the indenting member 104 extends beyond the distal most end 415 of the closest cutting element 403 to the axis 105 of rotation Preferably, the indenting member 104 does not extend beyond the nose portion 204. Surprisingly, if the indenting member 104 does not extend beyond the distal most end 415 of the closest cutting element 403, it was found that the drill bit 100 was only as stable as the typical commercially available shear bits. During testing it was found in some situations that if the indenting member 104 extended too far, it would be too weak to withstand radial forces produced from drilling or the indenting member 104 would reduce the depth-of-cut per rotation greater than desired.

Figure 14:
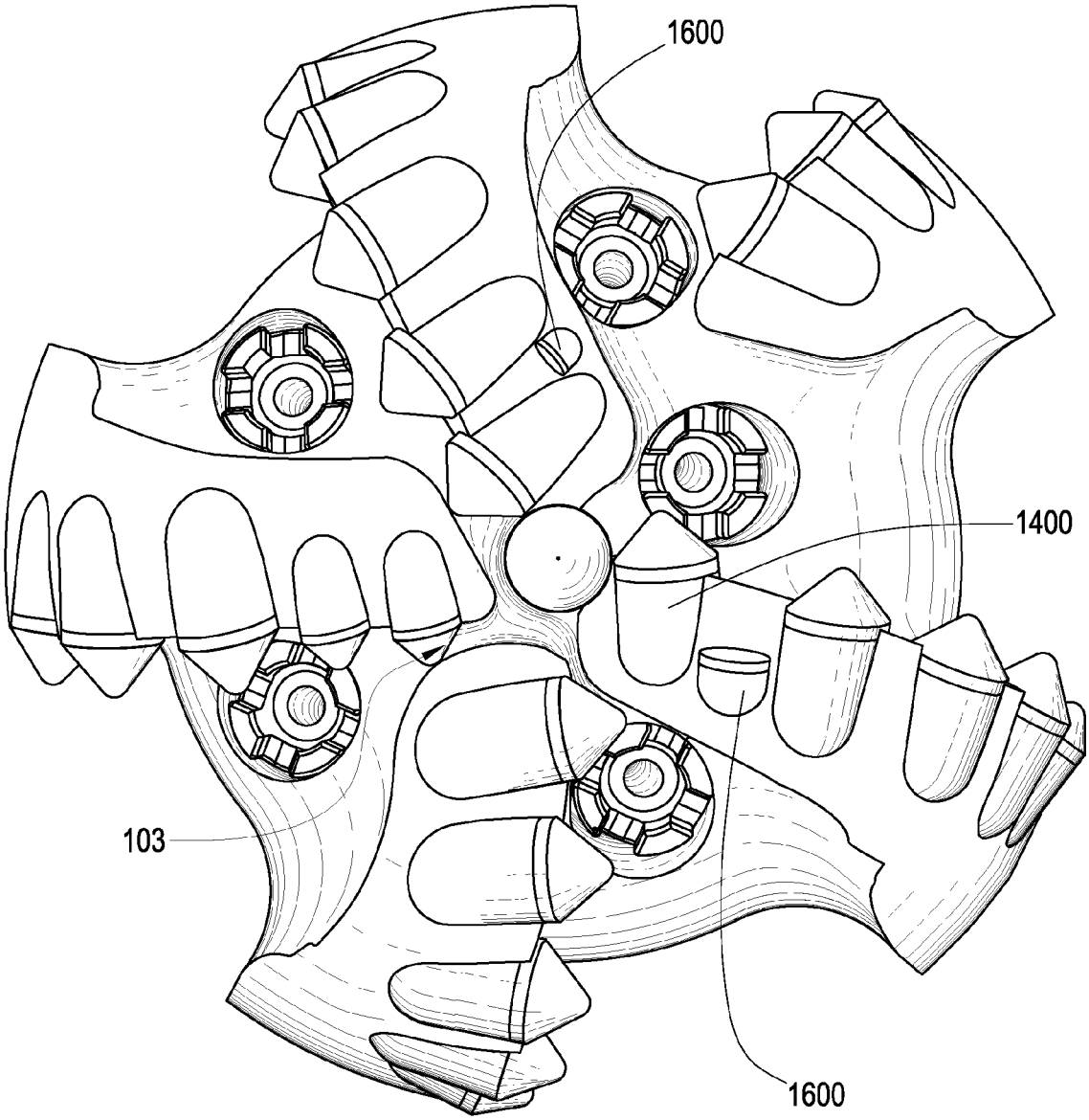
FIG. 14 is a perspective diagram of another embodiment of a drill bit.
Figure 15:
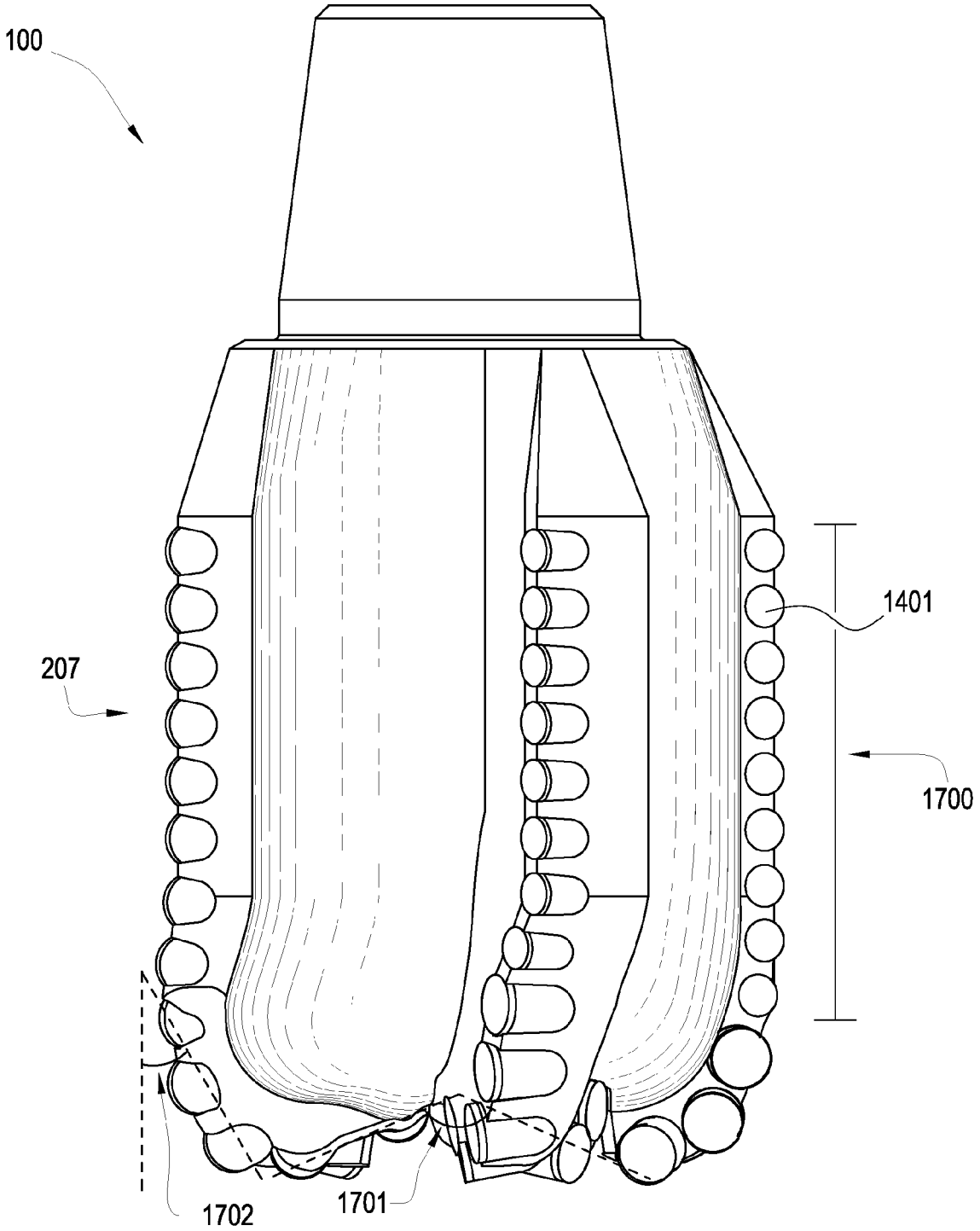
FIG. 15 is a perspective diagram of another embodiment of a drill bit.

One indication that stability is achieved by the indenting member 104 is the reduction of wear on the gauge cutting elements 1401 (See FIG. 15). In the test conducted at the Catoosa Facility in Rogers County, Oklahoma the present invention was used to drill a well of 780 ft in 6.24 hours through several formations including mostly sandstone and limestone. During this test it was found that there was little to no wear on any of the polycrystalline diamond cutting elements 1401 fixed to the gauge of the drill bit 100—which was not expected, especially since the gauge cutting elements 1401 had an aggressive diameter size of 13 mm, while the cutting elements 1400 (See FIG. 14) in the cone region 103 had 19 mm cutting elements. It is believed that this reduced wear indicates that there was significantly reduced bit whirl and that the drill bit 100 of the present invention drilled a substantially straight hole. The tests conducted in Colorado also found that the gauge cutting elements 1401 no little or no wear.

Figure 5:
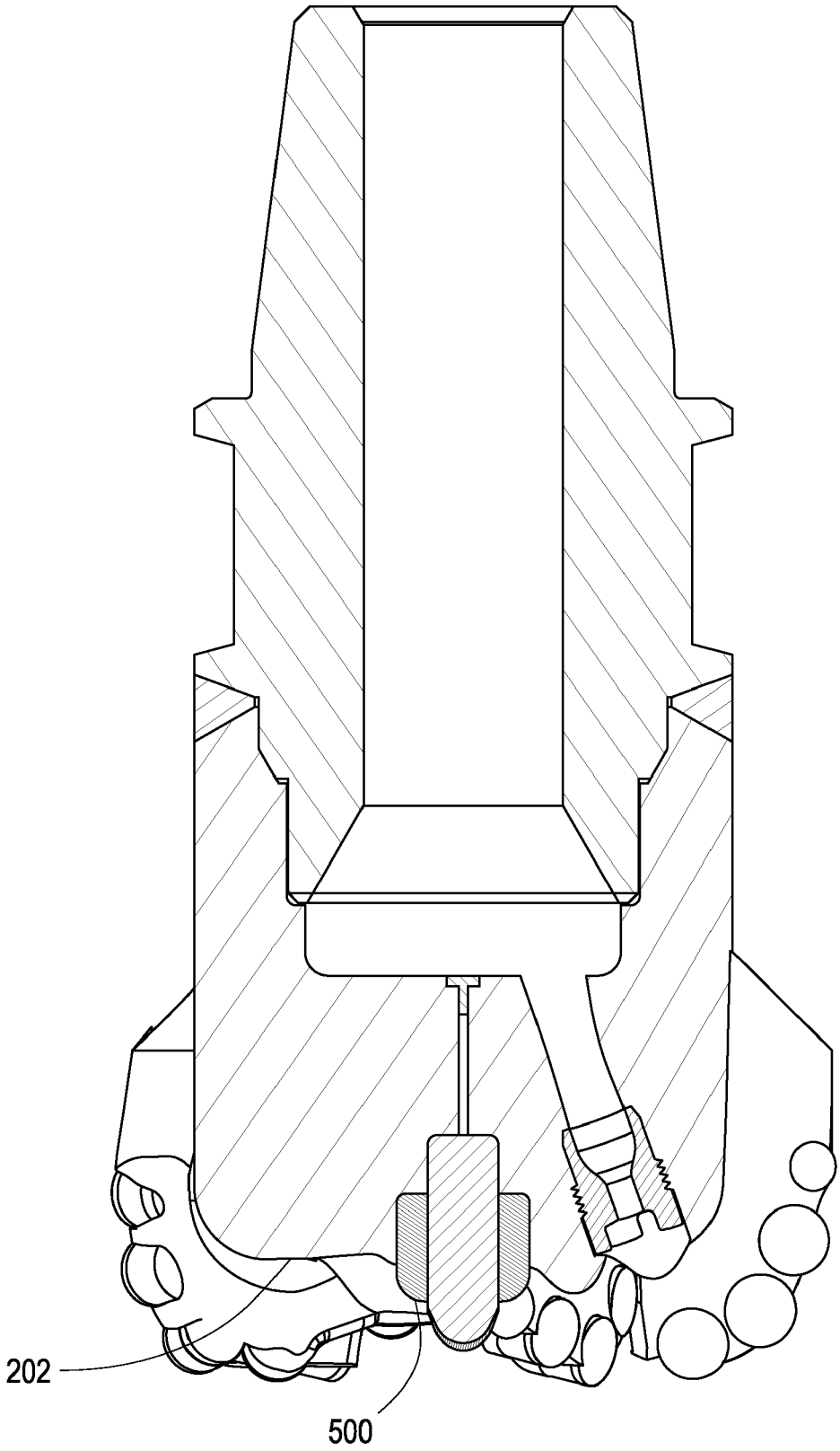
FIG. 5 is a cross sectional diagram of another embodiment of a drill bit.

Also shown in FIG. 4 is an extension 404 of the working face 202 of the drill bit 100 that forms a support around a portion of the indenting member 104. Because the nature of drilling produces lateral loads, the indenting member 104 must be robust enough to withstand them. The support from the extension 404 may provide the additional strength needed to withstand the lateral loads. In other embodiments, a ring 500 may be welded or otherwise bonded to the working face 202 to give the extra support as shown in FIG. 5. The ring 500 may be made of tungsten carbide or another material with sufficient strength. In some embodiments, the ring 500 is made a material with a hardness of at least 58 HRc.

Figure 6:
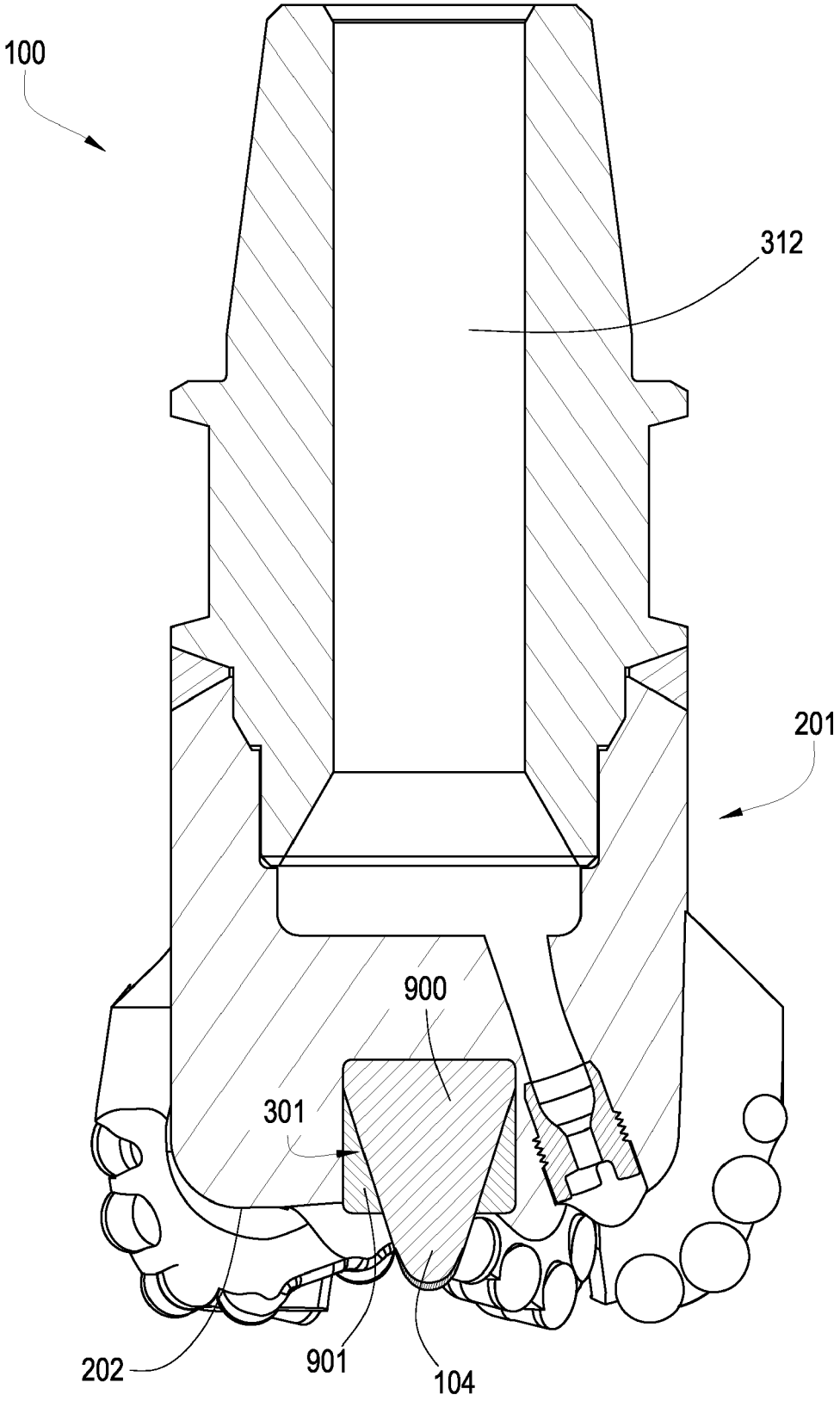
FIG. 6 is a cross sectional diagram of another embodiment of a drill bit.
Figure 7:
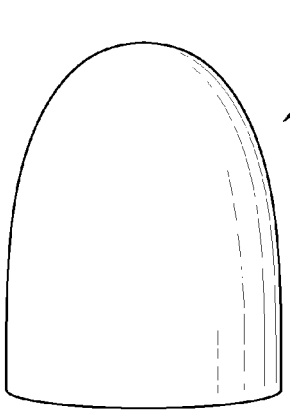
FIG. 7 is a perspective diagram of an embodiment of an indenting member of a drill bit.
Figure 8:
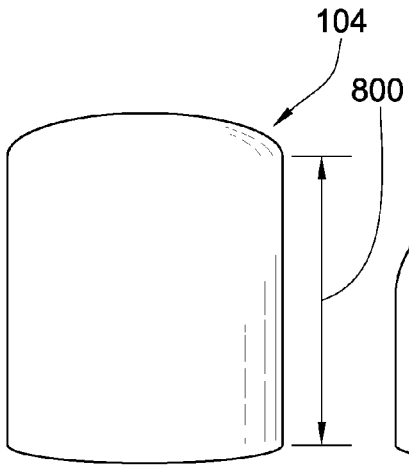
FIG. 8 is a perspective diagram of another embodiment of an indenting member of a drill bit.
Figure 9:
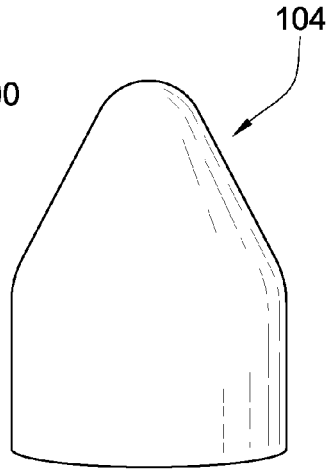
FIG. 9 is a perspective diagram of another embodiment of an indenting member of a drill bit.
Figure 10:
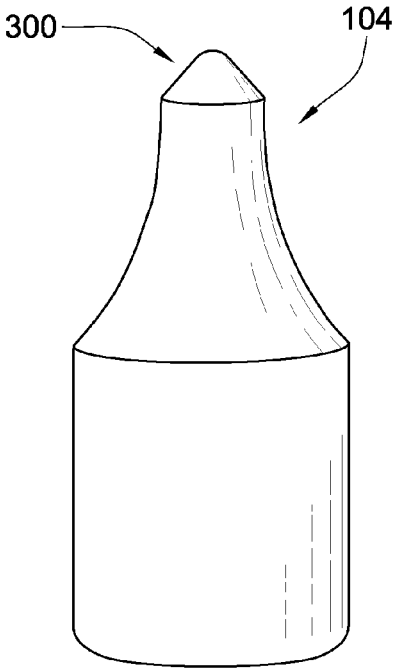
FIG. 10 is a perspective diagram of another embodiment of an indenting member of a drill bit.
Figure 11:
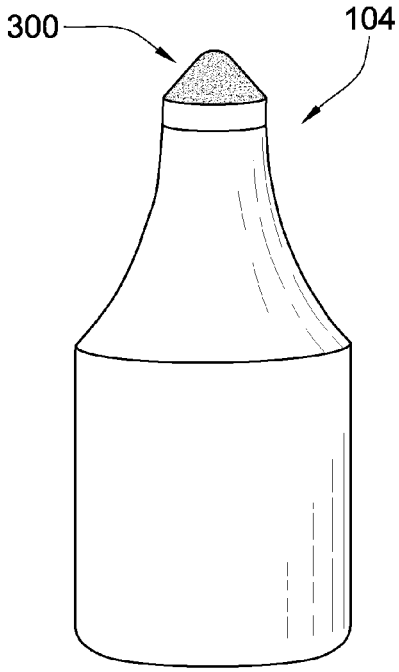
FIG. 11 is a perspective diagram of another embodiment of an indenting member of a drill bit.

FIG. 6 discloses a tapered indenting member 104. In the embodiment of FIG. 6 the entire indenting member 104 is tapered, although in some embodiments only a portion or portions of the indenting member 104 may be tapered. A tapered indenting member 104 may provide additional support to the indenting member 104 by preventing buckling or help resist lateral forces exerted on the indenting member 104. In such embodiments, the indenting member 104 may be inserted from either the working face 202 or the bore 312 of the drill bit 100. In either situation, a chamber 301 is formed in the bit body 201 and the tapered indenting member 104 is inserted. Additional material is then added into the exposed portion of the chamber 301 after the tapered indenting member 104 is added. The material may comprise the geometry of the exposed portion of the chamber 301, such as a cylinder, a ring, or a tapered ring. In the embodiment of FIG. 10, the tapered indenting member 104 is insertable from the working face 202 and a proximal end 900 of the indenting member 104 is brazed to the closed end of the chamber 301. A tapered ring 901 is then bonded into the remaining portion of the chamber 301. The tapered ring 901 may be welded, friction welded, brazed, glued, bolted, nailed, or otherwise fastened to the bit body 201.

FIGS. 7-11 disclose embodiments of the indenting member 104. The distal end of the indenting member 104 may comprise a blunt geometry of a generally semi-spherical shape, a generally flat shape, a generally conical shape, a generally round shape, a generally asymmetric shape, or combinations thereof. The indenting member 104 may comprise a substantially symmetric distal end. The indenting member 104 may be solid. The indenting member may be substantially cylindrical along its length 800, as in the embodiment of FIG. 8. The blunt geometry may be defined by the region of the indenting member 104 that engages the formation. In some embodiments, the blunt geometry comprises a surface area greater than an area of a cutting surface of one of the cutting elements 102 attached to one of the blades 101. The cutting surface of the cutting element 102 may be defined as a flat surface of the cutting element 102, the area that resists WOB, or in embodiments that use a diamond surface, the diamond surface may define the cutting surface. In some embodiments, the surface area of the blunt geometry is greater than twice the cutting element surface of one of the cutting elements 102. The indenting member 104 may be made of a cemented metal carbide. The distal end 206 of an indenting member 104 initially made of carbide may be removed and replaced with a distal end comprising diamond, as in the embodiment of FIG. 11.

Figure 12:
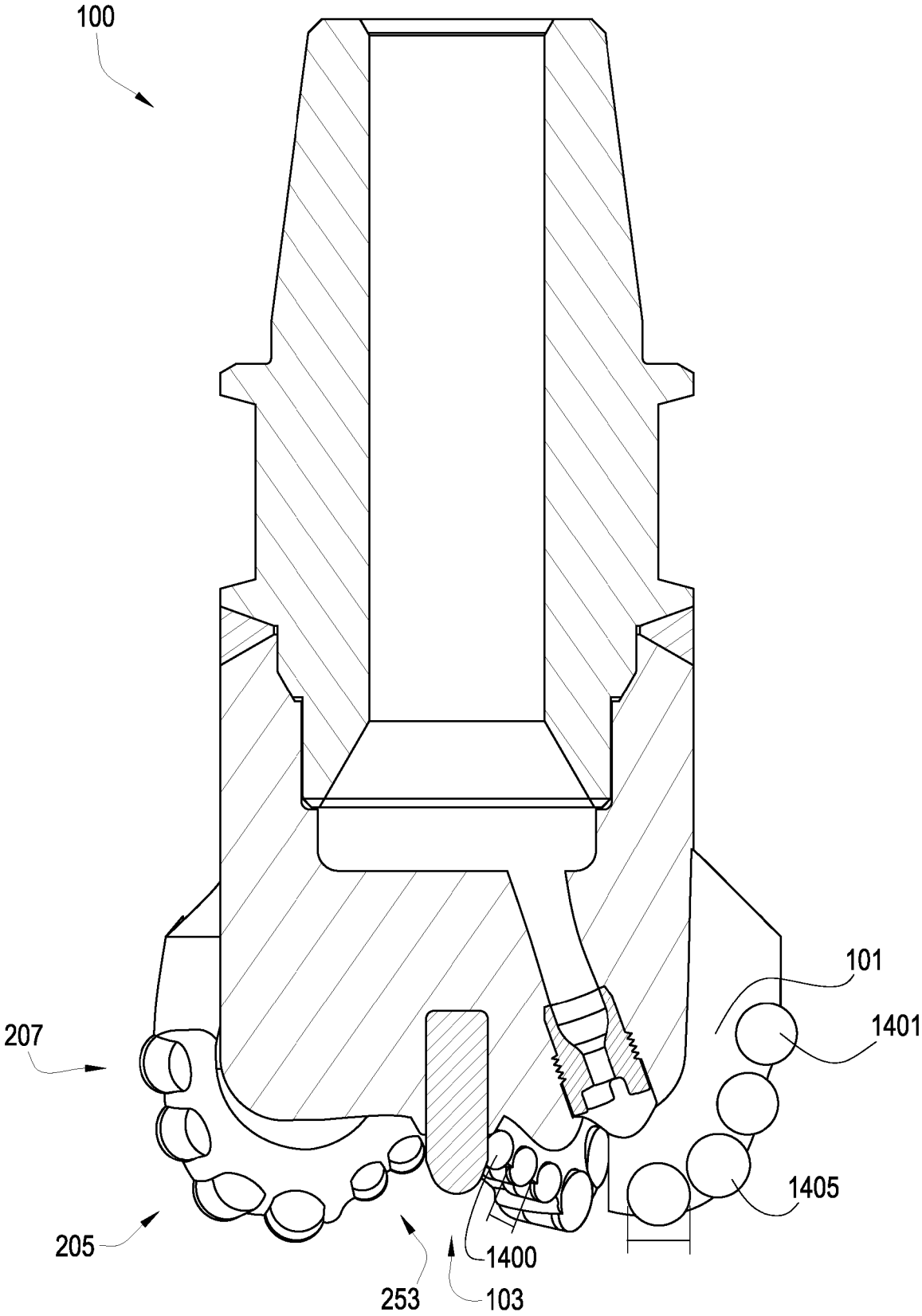
FIG. 12 is a cross sectional diagram of another embodiment of a drill bit.

FIG. 12 discloses a drill bit 100 of the present invention with cutting elements 1400 aligned on the cone portion 253 of the blades 101 which are smaller than the cutting elements 1401 on the flank or gauge portions 205, 207 of the bit 100. In the testing performed in both Colorado and Oklahoma locations, the cutting elements 1400 in the inverted cone region 103 received more wear than the flank or gauge cutting elements 1405, 1401, which is unusual since the cutting element velocity per rotation is less than the velocity of the cutting elements 1401 placed more peripheral to these inner cutting elements 1400. Since the inner cutting elements 1400 are now subjected to a more aggressive environment, the cutting elements 1400 may be reduced in size to make the cutting elements 1400 less aggressive. The cutting elements 1400 may also be chamfered around their edges to make them less aggressive. The cutting elements 102 on the drill bit 100 may be 5 to 50 mm. 13 and 19 mm are more common in the deep oil and gas drilling. In other embodiments, such as the embodiment of FIG. 14, the inner cutting elements 1400 may be positioned at a greater negative rake angle 1500 than the flank or gauge cutting elements 1405, 1401 to make them less aggressive. Any of the cutting elements 102 of the present invention may comprises a negative rake angle 1500 of 1 to 40 degrees. In some embodiments of the present invention, only the inner most cutting element on each blade has a reduced diameter than the other cutting elements or only the innermost diameter on each blade may be set at a more negative rake than the other cutting elements.

Figure 13:
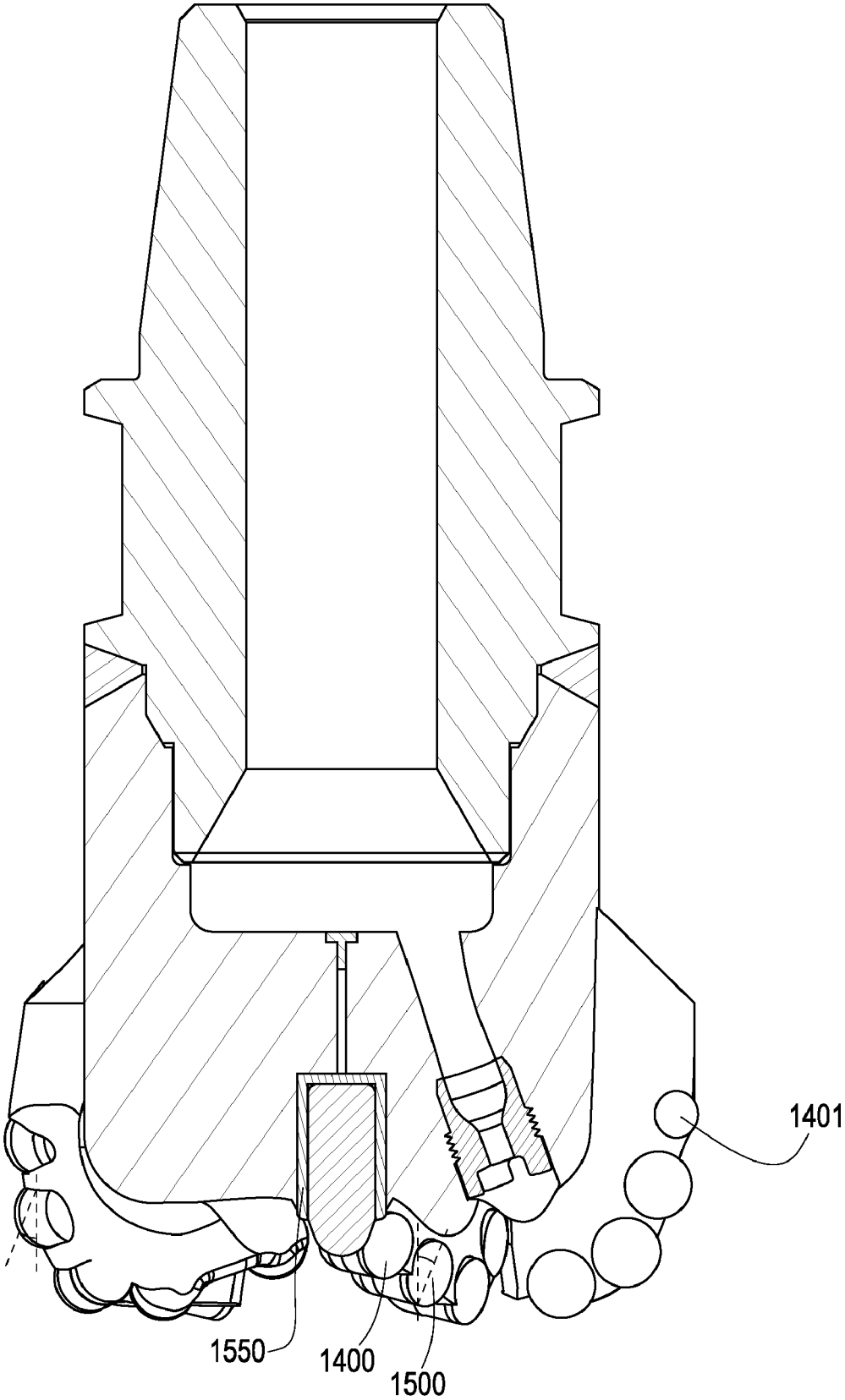
FIG. 13 is a bottom perspective diagram of another embodiment of a drill bit.

FIG. 13 also discloses a sleeve 1550 which may be brazed into a chamber formed in the working face. The indenting member may then be press fit into the sleeve. Instead of brazing the indenting member directly into working face, in some embodiment it may be advantageous to braze in the sleeve. When the braze material cools the sleeve may misalign from the axis of rotation. The inner diameter of the sleeve may be machined after it has cooled so the inner diameter is coaxial with the axis of rotation Then the indenting member may be press fit into the inner diameter of the sleeve and be coaxial with the axis of rotation.

FIG. 14 discloses another embodiment of the present invention where more cutting elements 1400 in the cone region 103 have been added. This may reduce the volume that each cutting element 1400 in the cone region 103 removes per rotation which may reduce the forces felt by the inner cutting elements 1400. Back-up cutting elements 1600 may be positioned between the inner cutting elements 1400 to prevent blade washout. The cutting elements 1400 may be pointed. The cutting elements may comprise a pointed geometries are shown.

FIG. 15 discloses an embodiment of the present invention with a long gauge length 1700. A long gauge length 1700 is believed to help stabilize the drill bit 100. A long gauge length 1700 in combination with an indenting member 104 may help with the stabilizing the bit 100. The gauge length 1700 may be 0.25 to 15 inches long. In some embodiments, the gauge portion 207 may comprise 3 to 21 cutting elements 102. The cutting elements 102 of the present invention may have several geometries to help make them more or less aggressive depending on their position on the drill bit 100. Some of these geometries may include a generally flat shape, a generally beveled shape, a generally rounded shape, a generally scooped shape, a generally chisel shape or combinations thereof. In some embodiments, the gauge cutting elements 1401 may comprise a small diameter than the cutting elements 1400 attached within the inverted cone region 103.

Figure 16:
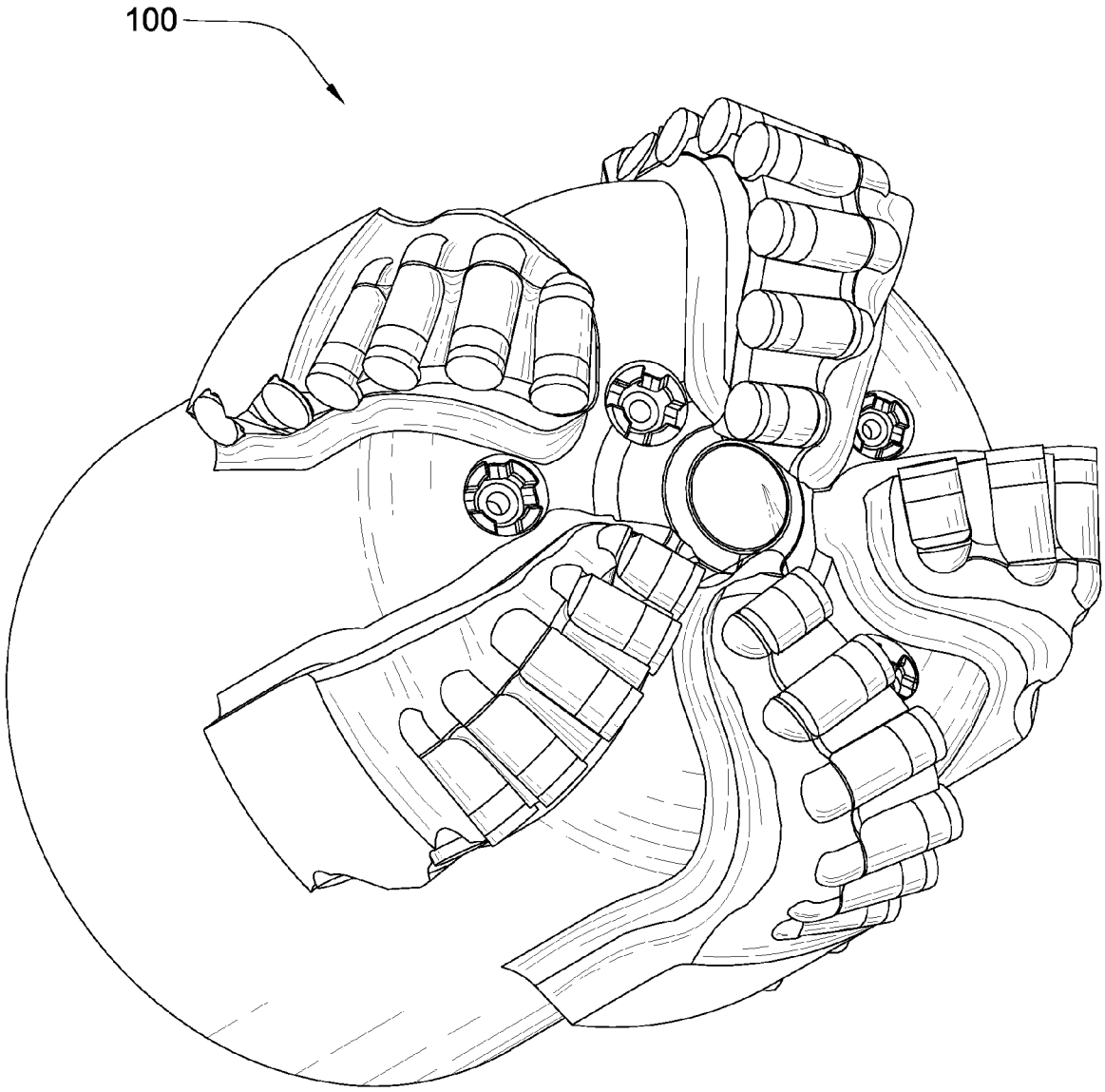
FIG. 16 is a perspective diagram of another embodiment of a drill bit.

FIG. 15 also discloses the cone angle 1701 and flank angle 1702 of the drill bit 100. These angles 1701, 1702 may be adjusted for different formations and different applications. Preferably, the cone angle 1701 may be anywhere from 25 to 155 degrees and the flank angle 1702 may be anywhere from 5 to 85 degrees. FIG. 16 also discloses another possible embodiment of the current invention in a drill bit 100 which has carbide studs backing up at least some of the cutting elements.

Figure 17:
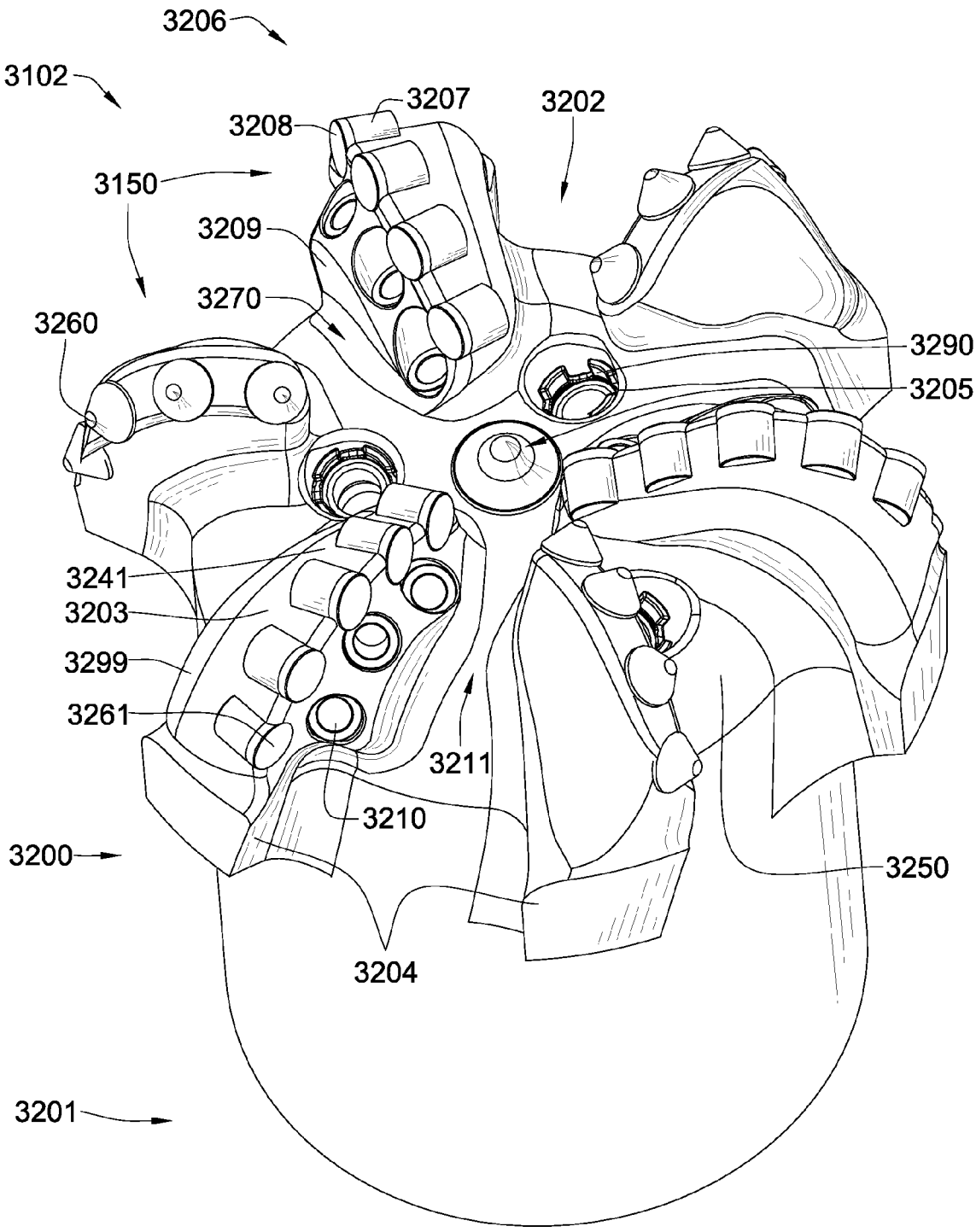
FIG. 17 is a perspective diagram of another embodiment of a drill bit.

FIG. 17 is a top perspective diagram of a drill bit 3102. The drill bit 3102 may comprise a body 3200 intermediate a shank 3201 and a working face 3202. The drill bit 3102 may comprise a plurality of blades 3150. The blades 3150 may be disposed on the working face 3202 of the drill bit 3102. The plurality of blades 3150 may converge towards a center of the working face 3202 and diverge towards a gauge 3204 of the working face 3202 creating junk slots 3250 intermediate the blades 3150. The blades 3150 may comprise a nose 3203 portion intermediate the gauge 3204 and a conical region 3241. The blades 3150 may also comprise a flank 3299 intermediate the gauge 3204 and the nose 3203 portion. The center of the working face 3202 may also comprise a substantially centered jack element 3205.

At least one blade 3150 may comprise at least one cutting surface 3206 with a carbide substrate 3207 bonded to a diamond working end 3208. The diamond working end 3208 may comprise a pointed cutting surface 3260 or a planar cutting surface 3261. The cutting surface 3206 may be used in drilling for oil and gas applications. During drilling often times debris can build up within the junk slots 3250 and impede the efficiency of the drill bit 3102. Immediately adjacent to the diamond working end 3208 may be at least one high-pressure nozzle 3210 adapted to remove debris from the drill bit 3102. The nozzle 3210 nearest the flank 3299 may be directed such that the fluid is directed away from the diamond working end 3208.

The at least one high-pressure nozzle 3210 may be disposed in an elevated surface 3209 within the junk slots 3250. The elevated surface 3209 may extend to the diamond working end 3208. The elevated surface 3209 may comprise a bottom 3270 that is opposite the diamond working end 3208 and is in contact with the base 3211 of the junk slot 3250. The elevated surface 3209 may also comprise a single side that is in contact with a blade 3150. The inner diameter of the at least one nozzle 3210 may be 0.2125-0.4125 inches. FIG. 17 also shows the at least one high-pressure nozzle 3210 in the elevated surface 3209 in front of the blades 3150 that comprise a diamond working end 3208 with a planar cutting surface 3261. FIG. 17 also shows nozzles 3290 disposed at the base 3211 of the junk slots 3250 in front of the blades 3150 that comprise a diamond working end 3208 with a pointed cutting surface 3260.

Whereas the present invention has been described in particular relation to the drawings attached hereto, it should be understood that other and further modifications apart from those shown or suggested herein, may be made within the scope and spirit of the present invention.

What is claimed is:

1. A drill bit, comprising:

a bit body intermediate a working face and a shank end adapted for connection to a downhole drill string;

the working face comprising at least three fixed blades converging towards a center of the working face and diverging towards a gauge of the bit;

at least one of the plurality of blades comprising a cone region adjacent the center of the working face;

the cone region increasing in height away from the center of the working face and towards a nose portion of the at least one blade;

an opening being formed in the working face at the center of the bit along an axis of the drill bit's rotation;

the opening leading into a chamber with at least one wall;

an indenting member being disposed within and extending from the opening and being substantially coaxial with the axis of rotation; and the indenting member being rotationally and axially fixed to the wall of the chamber and being made of a material harder than the bit body;

wherein a closest cutting element secured to the at least one blade comprises a distal most end located a distance from the working face, wherein the indenting member does not extend beyond the distance.

2. The drill bit of claim 1, wherein the indenting member is substantially cylindrical along its length.

3. The drill bit of claim 1, wherein the indenting member comprises a rounded distal end.

4. The drill bit of claim 3, wherein the rounded distal end comprises a domed shape, a conical shape, or a semi-spherical shape.

5. The drill bit of claim 1, wherein the indenting member is brazed to the wall of the chamber.

6. The drill bit of claim 1, wherein the indenting member is solid.

7. The drill bit of claim 1, wherein the center of the working face is within a cone region formed by the at least three blades.

8. The drill bit of claim 1, wherein the indenting member comprises a larger diameter than a cuffing element secured to at least one of the blades.

9. The drill bit of claim 1, wherein the indenting member comprises a larger volume than a cutting elements secured to at least one of the blades.

10. The drill bit of claim 1, wherein the indenting member comprises a substantially symmetric distal end.

11. The drill bit of claim 1, wherein the at least one blade also comprise a nose portion and a flank region.

12. The drill bit of claim 1, wherein the bit body is made of steel.

13. The drill bit of claim 1, wherein the bit body is made of matrix.

14. The drill bit of claim 1, wherein the indenting member is held within the chamber through an interference fit.

15. The drill bit of claim 1, wherein the chamber comprises a closed end.

16. The drill bit of claim 1, wherein the indenting member does not extend beyond a nose portion of the at least one blade.

17. The drill bit of claim 1, wherein the indenting member comprises a braze joint.

18. The drill bit of claim 1, wherein the chamber comprises a port in fluid communication with a bore formed in the bit body which is adapted to facilitate flow of drilling mud during a drilling operation.

19. The drill bit of claim 1, wherein a pointed cuffing element is secured to the at least one blade.

20. The drill bit of claim 1, wherein a junk slot comprising a base is formed by the blades; at least one high pressure nozzle disposed between at least two blades in a nozzle bore formed in an elevated surface from the base of the junk slots; the elevated surface being disposed adjacent the diamond working end of the least one cutting surface.

* * * * *

UNITED STATES PATENT AND TRADEMARK OFFICE

CERTIFICATE OF CORRECTION

PATENT NO. : 7,694,756 B2
APPLICATION NO. : 11/871644
DATED : April 13, 2010
INVENTOR(S) : David R. Hall et al.

It is certified that error appears in the above-identified patent and that said Letters Patent is hereby corrected as shown below:

In the Claims

In column 10, claim 8, line 59, after "a larger diameter than a" replace "cuffing" with --cutting--.

In column 12, claim 19, line 5, after "wherein a pointed" replace "cuffing" with --cutting--.

Signed and Sealed this
Fifteenth Day of May, 2012

David J. Kappos

David J. Kappos
*Director of the United States Patent and Trademark Office*